United States Patent [19]

Martin, Jr. et al.

[11] 4,173,869

[45] Nov. 13, 1979

[54] APPARATUS AND METHOD FOR DETERMINING THE ROTOR TEMPERATURE OF A STEAM TURBINE

[75] Inventors: James A. Martin, Jr., Newtown Township, Delaware County; Harry F. Martin, Middletown, both of Pa.; William R. Berry, Camden, N.J.

[73 Assignee: Westinghouse Electric Corp., Pittsburgh, Pa.

[21] Appl. No.: 876,396

[22] Filed: Feb. 9, 1978

[51] Int. Cl.[2] ..... F01K 13/02

[52] U.S. Cl. ..... 60/646; 60/657; 415/17; 415/47

[58] Field of Search ..... 60/646, 657; 417/17, 417/47

[56] References Cited

U.S. PATENT DOCUMENTS

| | | | |
|---|---|---|---|
| 3,291,146 | 12/1966 | Walker | 415/17 |
| 3,446,224 | 5/1969 | Zwicky, Jr. | 415/17 |
| 3,561,216 | 2/1971 | Moore, Jr. | 60/646 X |
| 3,577,733 | 5/1971 | Manuel | 60/646 |

*Primary Examiner*—Allen M. Ostrager
*Attorney, Agent, or Firm*—F. A. Winans

[57] ABSTRACT

Apparatus and method for automatically determining and indicating that the rotor of a steam turbine has attained a predetermined minimal temperature. Means are utilized for measuring axial dimensional changes of the steam turbine cylinder and rotor due to an increased temperature and summing pertinent axial dimensional changes thereby determining the axial expansion of the rotor which in turn, through known physical properties of the rotor material, corresponds to a temperature increase. This increase of the temperature added to the initial temperature of the rotor provides the total temperature, and upon the total temperature reaching a predetermined value, the steam turbine is available to be brought up to speed and loaded.

5 Claims, 1 Drawing Figure

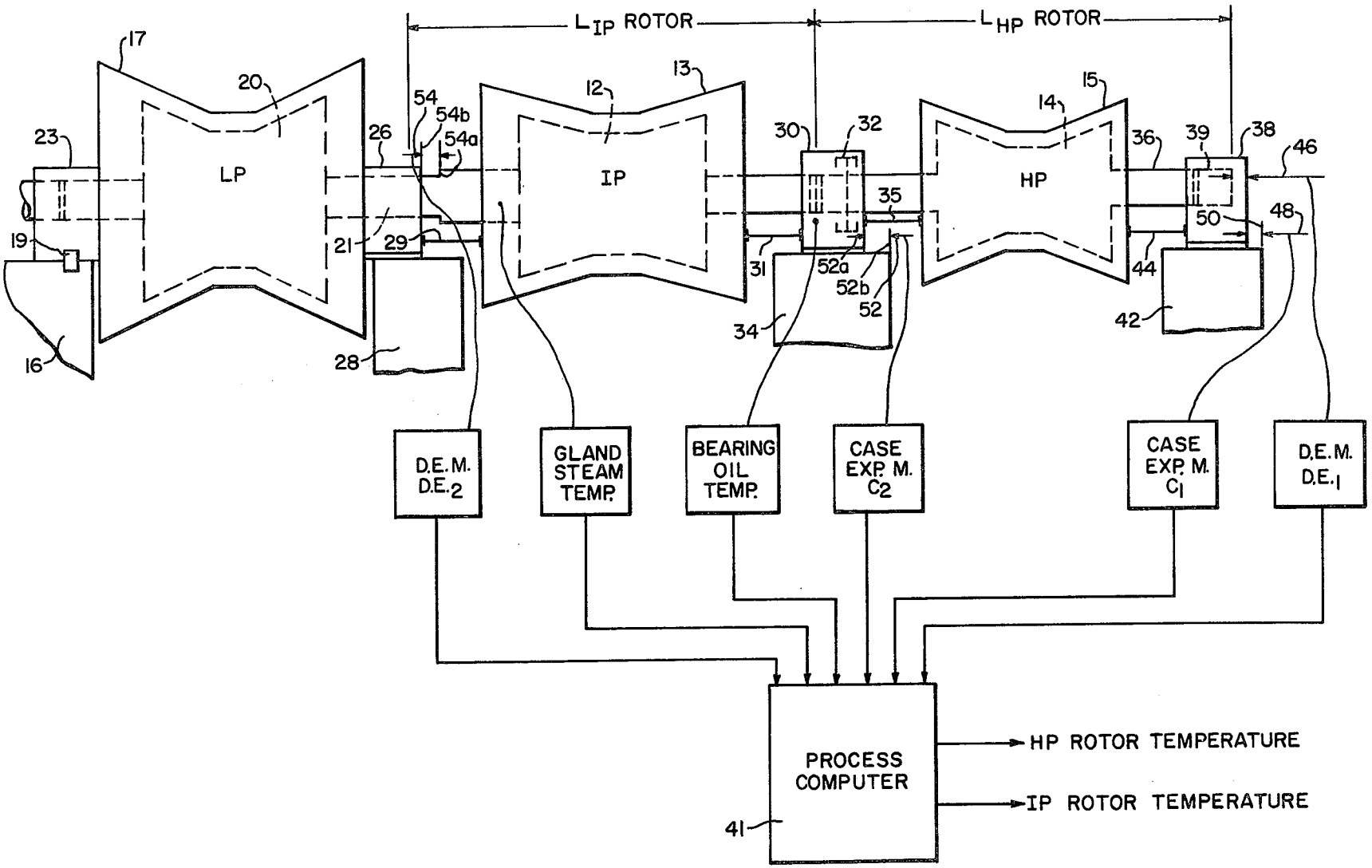
D.E.M. D.E.-1
CASE EXP. M. C1
CASE EXP. M. C2
BEARING OIL TEMP.
GLAND STEAM TEMP.
D.E.M. D.E.-2
HP ROTOR TEMPERATURE
IP ROTOR TEMPERATURE
PROCESS COMPUTER
HP
IP
LP
L HP ROTOR
L IP ROTOR

APPARATUS AND METHOD FOR DETERMINING THE ROTOR TEMPERATURE OF A STEAM TURBINE

BACKGROUND OF THE INVENTION

1. Field of the Invention

This invention relates to a high temperature steam turbine and more particularly to a method for automatically determining the temperature of the steam turbine rotor to permit loading of the turbine once its temperature reaches the transition temperature of the metal of the rotor.

2. Description of the Prior Art

The procedure for starting a high temperature steam turbine generally requires an initial heating of the rotor and cylinders to provide uniform build-up of heat for uniform expansion, thereby reducing thermally induced stresses and also requires the rotor to be heated above a temperature, referred to as the transition temperature, wherein the metal changes from a brittle character to a ductile character to avoid the hazard of brittle fracture caused by prematurely loading or stressing the rotor at temperatures below the transition temperature.

Heretofore, it has been common practice to provide a heat soak during startup wherein steam from the primary boiler was introduced into the cylinders through the throttle valves to bring the rotor up to about two-thirds normal speed and heat the rotors to at least 250° F., (generally considered to be the transition temperature) prior to bringing the rotor up to full speed and loading it. This generally requires on the order of 8 to 9 hours to fire the boiler plus an additional 4 to 6 hours based on heat transfer calculations to attain the 250° F. temperature of the rotor. In some instances, thermocouples are placed on a stationary structure generally adjacent the rotor to indicate the temperature of the stationary structure as a guide to the rotor temperature. This heating period for the turbine rotors is commonly referred to as a running heat soak.

In an attempt to reduce the time required to heat the rotor to the desired temperature and also reduce the energy required to provide this heat, a prewarm cycle has been recently utilized wherein steam from available auxiliary boilers, generally having much less capacity and therefore more quickly elevated to a high temperature, was introduced into the cylinders of a high temperature turbine while the main boiler was being fired. Also, in instances where the main boiler was ready prior to the turbine rotor temperature being above the transition temperature, steam from the main boiler would also be introduced to expedite the process in a normal running heat soak. However, because of variations in temperatures and capacities, the heat soak period could not be standardized for all applications. Although thermocouples could be placed on the stationary structure adjacent the rotor, there was sufficient discrepancy between this temperature indication and the actual temperature of the rotor that an alternate, more accurate system of determining the rotor temperature would be useful to assure the operator that the rotor was at least above the transition temperature and the turbine available for loading.

One method of determining the temperature of the rotor comprises manually measuring certain axial dimensional changes of the rotor and cylinder and determining the axial expansion therefrom which in turn permits calculation of the temperature of the rotor.

Although in the abstract, it would seem that such manual measurements could readily be made, in practice, because of the limited space available for such measurements, the complex nature of the structure involved in addition to the rotation thereof, and the generally hot environment in which such manual measurements were required to be made with extreme accuracy, the measurements were awkward and inconvenient to manually acquire. Therefore, the process was apt to be ignored. Further, each time such measurements were taken, (i.e. at regular short term intervals during warmup) it was necessary to insert them into a certain summation prior to obtaining the total axial dimensional change, and this result was again required to be used either through formulas, or graphs, etc., to determine the temperature of the rotor.

SUMMARY OF THE INVENTION

This invention provides apparatus and method utilizing signals from electronic probes for monitoring the expansion of the axial dimension of the rotor through both the high pressure and intermediate pressure cylinders of a tandem high temperature steam turbine and automatically correlating the signals due to such dimensional change to an increase in the temperature of the rotor and either indicating the average temperature of the rotor or indicating that the turbine is available for loading.

BRIEF DESCRIPTION OF THE DRAWING

The singe FIGURE is a schematic longitudinal view of a typical reheat steam turbine apparatus comprising a high pressure turbine, an intermediate pressure turbine, and a low pressure turbine serially disposed along a common rotor axis and illustrating the points for obtaining signals corresponding to the axial dimensional changes relevant to the present invention and directing the signals to a process computer.

DESCRIPTION OF THE PREFERRED EMBODIMENT

Referring to the FIGURE, a compound tandem steam turbine set is shown comprising from left to right a low pressure steam turbine LP, an intermediate pressure steam turbine IP and a high pressure steam turbine HP. Both HP and IP turbines are high temperature turbines, i.e., the inlet steam is on the order of 1000° F., and thus each has a rotor 12, 14 of an alloy material capable of withstanding relatively high stresses (due to centrifugal force, high-bending forces and thermal stress) at the elevated temperature. Such material generally has a brittle characteristic at the lower temperatures, and, as the temperature increases, the material becomes less brittle until at some temperature range it becomes ductile and capable of withstanding such forces without brittle fracture. This temperature range is referred to as a transition temperature and for the most part is somewhat below 250° F. It is thus important to heat the rotors 12, 14 of these high temperature turbines (IP, HP) to above the transition temperature prior to running them up to rated speed and loading them. Because the rotors of the LP turbine are not exposed to such high temperature and pressures, the stress they experience is accommodated by a metal that does not have such a high transition temperature and therefore, the temperature of the LP rotor prior to being loaded is not critical.

In the turbine set of the FIGURE, it is seen that the shaft extending to the left from the LP turbine is supported on a foundation pedestal 16 on which the cylinder 17 of the LP turbine is axially stationarily mounted to the foundation as by anchoring members 19 engaging an integral extension 23 of the cylinder 17 and seated in the pedestal so as to prevent axial movement relative thereto.

The rotor 20 of the LP turbine and the rotor 12 of the IP turbine are secured together through a jack shaft 21 which is housed in an LP bearing housing 26 which in turn is supported on a foundation pedestal 28 in a manner that permits axial movement of the housing 26 relative to the pedestal 28 to accommodate expansion of the turbine cylinder 17 and attached bearing housing 26. The cylinder 13 of the IP turbine is secured to the housing 26 by an interconnecting web member 29.

The interface of the IP and HP turbine rotors 12, 14 is housed in a thrust bearing housing 30 with the thrust bearing 32 providing axial anchoring of the rotors 12, 14 with respect to the IP cylinder 13 and HP cylinder 15. The cylinder 13 of the IP turbine and the cylinder 15 of the HP turbine are securely attached through web connectors 31 and 35 respectively to the thrust bearing housing 30 which is free to move axially on a thrust bearing pedestal 34. The terminal end 36 of the rotor 14 extending from the HP turbine casing 15 is coupled to a stub shaft 39 driving a main oil pump impeller housed in a casing 38 also housing bearing means for the rotor end. The casing 38 in turn is supported on a governor pedestal 42 for axial movement thereon with the casing 38 attached to the HP cylinder 15 through an adjoining web connector 44.

Thus it is seen, as each cylinder 13, 15 and 17 expands it produces an equivalent movement in any bearing housing and/or governor housing to the right, i.e., toward the end 36. Also, any expansion in the axial dimension of the rotor 12 of the IP turbine, in that axial movement with respect to the cylinder 13 is prevented at the thrust bearing 32, will manifest itself as a change in the relative position of the opposite end of the rotor 12 with respect to the adjacent structure of the cylinder 13. And any axial expansion of the HP rotor 14 will likewise manifest itself as an axial dimensional change between adjacent points on the rotor 14 and the governor housing 38.

The invention utilizes the relative axial dimensional changes due to expansion to determine, via the process computer 41, the temperature of both the IP and HP rotors 12 and 14 respectively. Thus, a first proximity gauge 46, such as the type well known in the art for monitoring vibration in rotating equipment via non-contacting eddy-current proximity probes (schematically represented by arrows), is mounted on the governor housing 38 such that the probe is adjacent the end of the stub shaft 39 in the housing to produce a response calibrated to correspond to the distance between the extreme end of the stub shaft 29 and an axially adjacent point on the governor housing. This distance is designated differential expansion measurement $DE_1$ and the signal generated thereby is fed to the computer 41. A second proximity gauge or probe 48 is mounted so as to produce a response related to the axial distance between a point on the governor housing 38 and an axially adjacent reference point 50 on the stationary governor housing pedestal 42 designated as casing expansion measurement $C_1$ which signal is also fed to the computer 41.

A third proximity gauge 52 is mounted so as to produce a response related to the axial distance between a reference point **52*a* on the thrust bearing housing 30 which moves axially in accordance with expansion and an adjacent stationary reference point 52*b* on the thrust bearing housing pedestal 34. This axial distance is designated casing expansion measurement $C_2$ and is also fed to the computer. A fourth proximity gauge 54 is mounted so as to produce a response related to the axial distance between a reference point 54*a* on the rotor 12 adjacent the LP bearing housing 26 and a reference point 54*b* on the LP bearing housing designated differential expansion measurement $DE_2$ which is again fed to the computer 41. It will be noted that as the IP and HP turbines are being heated to a much greater extent than the LP turbine, there will be relatively little expansion in the LP cylinder. Therefore the point 54*b* corresponding to the IP bearing housing can be considered to be stationary as there is minimal axial dimensional change in this position from the stationary bearing support 16**.

It is apparent that the gauges can be mounted to face either abrupt or tapered surfaces whose distance from a reference point changes with axial dimensional changes and the output signal of the proximity gauges can be correlated to an axial dimension, i.e. the dimensional change in the gap between the stationary proximity gauge and the adjacent rotating member will produce a change in the signal from the gauge that can be calibrated to inches, so that the axial expansion can automatically be indicated by the signals of the various gauges as an absolute dimension. However, the signals of the proximity gauges according to the present invention are fed to a central plant control system computer or microprocessor computer system 41, which is programmed to do the following calculations automatically and either indicate a rotor temperature based on these calculations or only indicate a go/no-go condition for the rotors. However it is accomplished, the axial dimensional changes (indicated by $\Delta$) must be related to the increase in temperature from ambient of the rotors in the manner to be described.

As previously stated the bearing housing 23 provides the stationary point from which the turbine stationary components expand axially. The thrust bearing pedestal 34 supports the thrust bearing 32 and provides a stationary reference point **52*b* from which expansion of the IP cylinder 13 and IP rotor 12 can be determined. And the thrust bearing pedestal 34 provides a stationary reference for measuring axial displacement of the HP cylinder 15 and HP rotor 14**. From these known dimensions, the axial expansions of the respective parts can be determined according to the following relationships:

$\Delta C_2$ corresponds to the axial expansion of the IP cylinder 13;

$\Delta C_1 - \Delta C_2$ corresponds to the axial expansion of the HP cylinder 15;

$\Delta C_1 - \Delta C_2 + \Delta DE_1$ corresponds to the axial expansion of the HP rotor 14; and $\Delta C_2 + \Delta DE_2$ corresponds to the axial expansion of the IP rotor 12.

$\Delta C_1$, $\Delta C_2$, $\Delta DE_1$ and $\Delta DE_2$ are taken as positive numbers for the case of a decrease in the respective distances $C_1$, $C_2$, $DE_1$ and $DE_2$ relative to their initial values with the entire system at ambient room temperature.

The above expressed axial expansion of the HP rotor and IP rotor both include expansion due to a portion of the rotor (i.e. the small diameter portions thereof)

which are subjected to gland sealing steam and are also subjected to heated journal bearing oil. To be able to determine from such measurements that the main body portion being heated is above the transition temperature, the measured expansion of each rotor must be corrected by the amount of axial expansion attributed to such portions. Thus, the measured axial rotor expansions would each be decreased by an amount corresponding to the coefficient of thermal expansion ($\alpha$, which is substantially constant throughout the temperature range involved) multiplied by the respective known axial length of each small diameter section and by the known temperature change from ambient as measured by the gland steam temperature or the journal bearing oil temperature probe. Thus with the measured expansion of the respective rotors decreased by the expansion thereof of the small diameter portions, the resultant axial expansion of the main body portion of each rotor is known and hereafter is represented $\Delta L_{HP}$ and $\Delta L_{IP}$ respectively.

Again from this known physical relationship of $\Delta L = \alpha L \Delta T$, wherein $\alpha$ is the coefficient of thermal expansion for the metal of the rotors, and L is the initial axial length of the main body of each respective rotor, the following can be determined:

$\Delta T = (\Delta L/\alpha L)$ which in turn $= \Delta L/K$ wherein K represents the two constants $\alpha L$ (with the K for each rotor being different).

From the above expression, $\Delta T$ is determined from:

$$(\Delta L_{HP})/(K_{HP\ rotor})$$

for the HP rotor; and, $$(\Delta L_{IP})/(K_{IP\ rotor})$$

for the IP rotor. Each respective $\Delta T$ when added to the initial, i.e. ambient, temperature of the respective rotor provides the average temperature of the main body portion of the respective rotors at the time in the heating process.

The main body temperature of the rotor is thus determined from the measured expansion data, factoring in any correction for the expansion of the rotor ends exteriorly of the casing due to measured bearing oil temperature and gland steam temperature.

With the process computer programmed to continuously make these calculations on the information delivered to it from the various proximity and temperature probes, the computer can either indicate the average rotor temperature or a go/no-go condition for the earliest loading of the turbine without brittle fracturing of the rotors.

What we claim is:

1. In a steam turbine unit including a high temperature steam turbine comprising a casing housing a rotor and wherein said rotor has a critical minimum temperature to which it must be heated prior to fully loading the unit to prevent brittle fracture of said rotor, automatic means for indicating said rotor has been heated to at least said temperature, said means comrpising:

a plurality of signal generating means, at least one of said means mounted adjacent said casing and at least another of said means mounted adjacent said rotor, said means generating signals corresponding to the axial dimensional changes of the respective adjacent turbine structure;

means for receiving the signals of said signal generating means and automatically indicating therefrom, based on a known relationship between axial expansion and temperature, the temperature of the rotor relative to the minimum critical temperature.

2. Structure according to claim 1 wherein said turbine unit includes at least two high temperature steam turbines having a common rotor shaft extending therebetween and said signal generating means are positioned to produce signals responsive to expansion attributable to the casing of each turbine and at least two more said means positioned to produce signals responsive to a dimensional change between each of said rotors and a corresponding reference point and whereby said signal receiving means sums said signals in a manner to provide the axial dimensional change of the rotor within each casing to indicate the temperature of the rotor within each turbine casing relative to said minimum critical temperature.

3. Structure according to claim 2 wherein said turbine unit is anchored outboard of one of said high temperature turbines to limit axial expansion in one direction therefrom and further includes a thrust bearing interposed between said casings and means attaching each casing of said turbines to the housing of the bearing and wherein said signal generating means comprises:

a first signal generating means providing a signal corresponding to the dimensional change between a stationary reference point generally adjacent said anchoring member and an adjacent axial position on said rotor and referred to as $\Delta DE_2$;

second signal generating means providing a signal corresponding to the axial dimensional change between a reference point on the thrust bearing housing and an adjacent stationary reference point and referred to hereinafter as $\Delta C_2$;

third signal generating means providing a signal corresponding to the dimensional change between a reference point on the outer end of the outermost turbine casing and an adjacent axial position of the turbine rotor and referred to hereinafter as $\Delta DE_1$; and, a fourth signal generating means providing a signal corresponding to the axial dimensional change between a point on the outer end of said outermost casing and an adjacent stationary reference point and referred to hereinafter as $\Delta C_1$;

and wherein said signals are received by said receiving means for calculating the axial rotor expansion in one turbine casing as $\Delta C_2 + \Delta DE_2$ and axial rotor expansion in the other casing as $\Delta C_1 - \Delta C_2 + \Delta DE_1$ and based on said known relationship between axial expansion and temperature, said receiving means further indicates the temperature of the rotor within the respective casings relative to the minimum critical temperature.

4. In a steam turbine unit comprising a first and second adjacent high temperature steam turbine, each having a casing with a common rotor shaft extending therebetween, said unit stationarily axially anchored at one position adjacent said first casing and axially movable bearing means for rotatively supporting said common shaft while accommodating axial dimensional changes in said rotor and said casings; said casings structurally connected to said other and at least one thrust bearing secured to one of said casing and engaging said rotor to axially position said rotor relative to said casings as said casings expand, and means for automatically determining the temperature of said rotor in each said casing; said means comprising:

a plurality of signal generating means mounted adjacent said casings and said rotor for generating a signal corresponding to the dimensional change in the axial direction of the respective adjacent turbine structure; and, means for receiving the signals of said signal generating means and automatically indicating therefrom, based on a known relationship between axial expansion and temperature, the temperature of the rotor within each casing.

5. Structure according to claim 4 wherein said signal generating means comprises a first such means mounted on first turbine casing generally closely spaced from an axially facing portion of said rotor adjacent an outer end for generating a signal corresponding to the dimensional change in the axial direction in the spaced relationship therebetween and referred to hereinafter as $\Delta DE_2$;

a second such means mounted on a stationary structure generally closely spaced axially from a facing reference surface on said thrust bearing casing for generating a signal corresponding to the dimension change in the spaced relationship therebetween and referred to hereinafter as $\Delta C_2$;

a third such means mounted on said second turbine casing generally closely spaced axially from a facing reference surface of said rotor adjacent an outer end for generating a signal corresponding to the axial dimensional change in the spaced relationship therebetween and referred to hereinafter as $\Delta DE_1$;

a fourth such means mounted on stationary structure generally closely spaced axially from a reference surface on the outer end of said second turbine casing for generating a signal corresponding to the axial dimensional change in the spaced relationship therebetween and referred to hereinafter as $\Delta C_1$; and wherein, said signals are received by said receiving means for determining rotor axial expansion within the first turbine as a summation of $\Delta C_2+\Delta DE_2$, and rotor axial expansion in the second turbine casing as a summation of $\Delta C_1-\Delta C_2+\Delta DE_1$, and based on said axial expansion of said rotor in each said turbine casing indicating a corresponding temperature of each said rotor therein according to said known physical relationship.

* * * * *